US008678779B2

(12) United States Patent
Yoshizawa et al.

(10) Patent No.: US 8,678,779 B2
(45) Date of Patent: Mar. 25, 2014

(54) FUEL PUMP

(75) Inventors: Takashi Yoshizawa, Novi, MI (US); Donald J. McCune, Farmington Hills, MI (US); Harsha Badarinarayan, Canton, MI (US); Akira Inoue, Farmington Hills, MI (US)

(73) Assignee: Hitachi, Ltd., Tokyo (JP)

( * ) Notice: Subject to any disclaimer, the term of this patent is extended or adjusted under 35 U.S.C. 154(b) by 706 days.

(21) Appl. No.: 12/718,395

(22) Filed: Mar. 5, 2010

(65) Prior Publication Data

US 2011/0217186 A1 Sep. 8, 2011

(51) Int. Cl.
*F04B 49/22* (2006.01)

(52) U.S. Cl.
USPC ..... 417/297; 251/48

(58) Field of Classification Search
USPC ..... 251/48; 417/297, 298
See application file for complete search history.

(56) References Cited

U.S. PATENT DOCUMENTS

| | | | | |
|---|---|---|---|---|
| 6,098,644 | A * | 8/2000 | Ichinose | 137/1 |
| 6,694,952 | B1 * | 2/2004 | Yamazaki et al. | 123/496 |
| 7,036,487 | B2 | 5/2006 | Braun et al. | |
| 7,055,539 | B2 * | 6/2006 | Suzuki | 137/1 |
| 7,240,754 | B2 | 7/2007 | Barta et al. | |
| 7,278,401 | B1 | 10/2007 | Cotton et al. | |
| 7,296,543 | B2 | 11/2007 | Namuduri et al. | |
| 7,302,938 | B2 | 12/2007 | Yu et al. | |
| 7,406,946 | B1 | 8/2008 | Watanabe et al. | |
| 7,463,967 | B2 | 12/2008 | Ancimer et al. | |
| 7,490,707 | B2 | 2/2009 | Robb et al. | |
| 7,588,131 | B2 | 9/2009 | Steinwender | |
| 7,600,616 | B2 | 10/2009 | Anderfaas et al. | |
| 2006/0137657 | A1 * | 6/2006 | Ricco et al. | 123/458 |

FOREIGN PATENT DOCUMENTS

| | | |
|---|---|---|
| JP | 2003-007531 A | 1/2003 |
| JP | 2003-161226 A | 6/2003 |

OTHER PUBLICATIONS

Japanese Office Action dated Mar. 21, 2012 relating to JP Application No. JP 2010-209011.

* cited by examiner

*Primary Examiner* — Charles Freay
*Assistant Examiner* — Philip Stimpert
(74) *Attorney, Agent, or Firm* — Gifford, Krass, Sprinkle, Anderson & Citkowski, P.C.

(57) ABSTRACT

A high pressure fuel pump for use with a direct injection engine having a housing which defines a pump chamber. A port is formed in the housing which fluidly connects a fuel in the passageway with the pump chamber. An elongated valve is movably mounted within the housing between an open and a closed position. In its open position, the inlet passageway is fluidly connected with the pump chamber while, conversely, in the closed position the fuel valve blocks the fluid flow between the inlet passageway and the pump chamber. A circuit controls the deceleration of the valve to reduce pump noise.

17 Claims, 7 Drawing Sheets

FUEL PUMP

BACKGROUND OF THE INVENTION

I. Field of the Invention

The present invention relates to fuel pumps and, more particularly, to a high pressure fuel pump for use with a direct injection internal combustion engine.

II. Description of Related Art

Direct injection internal combustion engines are enjoying increased popularity, particularly in the automotive industry. In a direct injection internal combustion engine, the fuel is injected directly into the internal combustion chamber. Such direct injection engines enjoy increased engine efficiency, fuel economy, and reduced emissions.

Since the fuel is injected directly into the internal combustion chamber in a direct injection engine, the fuel supply to the fuel injectors must necessarily be provided at a high pressure. In order to accomplish this, a high pressure fuel pump provides high pressure fuel to fuel rails which are, in turn, fluidly connected to the fuel injectors for the engine.

With reference first to FIG. 1, a typical prior art fuel pump 20 for a direct injection engine is shown. This fuel pump 20 includes a housing 22 which defines an internal pump chamber 24 having an outlet port 26. The outlet port 26 is connected to a fuel rail (not shown) through a one-way valve 28.

Still referring to FIG. 1, the housing 22 includes a fuel inlet passageway 30 which is fluidly connected to a source of fuel. This fuel inlet passageway 30 is fluidly connected to the pump chamber 24 through a port 32 formed in the housing 22.

In order to pump fuel from the pump chamber 24 out through the outlet port 26, a piston 34 has one end positioned within the pump chamber 24 and is reciprocally driven by the camshaft of the engine. Consequently, as the piston 34 moves into the pump chamber 24, the piston 34 pressurizes the fuel in the pump chamber 24 thus forcing the fuel out through the outlet port 26 and to the fuel rail assuming that the inlet port 32 is closed. Conversely, as the piston 34 moves outwardly from the pump chamber 24, the piston 34 inducts fuel through the inlet passage 30 and inlet port 32, assuming that it is open, and into the pump chamber 24.

A valve 36 is axially slidably mounted within the housing 22 and this valve 36 includes an enlarged diameter valve head 38 which overlies the inlet port 32 to the pump chamber 24. When the valve 36 is extended so that the valve head 38 is spaced apart from the port 32, the flow of fuel from the inlet passageway 30 and to the pump chamber 24 can occur through the inlet port 32. Conversely, with the valve head 38 abutting against the port 32, the valve head 38 closes the inlet port 32 so that fuel is pumped out through the outlet port 26 as the piston 34 moves into the pump chamber 24.

In order to control the movement of the valve 36 between its open and closed position, a spring 40 urges the valve 36 towards its closed position while a solenoid 42, when activated, holds the valve 36 in an open position. Consequently, upon deactivation of the solenoid 42, the spring 40 returns the valve to its closed position thus terminating fluid flow through the inlet port 32.

In operation, the movement of the piston 34 out from the pump chamber 24 creates a suction which moves the valve 36 to an open position. Once open, the actuation of the solenoid 42 maintains the valve 36 in its open position thus allowing fuel flow from the inlet passageway 30 into the pump chamber 24. As the piston 34 begins to move back into the pump chamber 24, deactivation of the solenoid 42 allows the spring 40 to return the valve 36 to its closed position so that the pressurized fuel in the pump chamber 24 flows out through the outlet port 26 as desired.

While the previously known fuel pumps for direct injection engines have proven adequate in supplying sufficient high pressure fuel to the fuel rails for the engine, the fuel pump creates an undesirable high level of noise for automotive uses. Most of this noise, furthermore, is attributable to contact or impact between the valve 36 and the pump housing 22 as the valve 36 reciprocates between its open and its closed position. This contact occurs not only between the valve head 38 and the valve seat 39 forming the inlet port 32, but also between an anchor 44 of the valve 36 and the pump housing.

SUMMARY OF THE PRESENT INVENTION

The present invention provides a plurality of pump designs which overcome the above-mentioned disadvantages of the previously known pump designs.

The pump design of the present invention also includes a pump housing which defines a pump chamber as well as a piston reciprocally mounted to the housing and movable into and out from the pump chamber. The present design also includes a valve which is movably mounted in the housing and which establishes fluid communication between the inlet passageway and the pump chamber as well as blocks fluid flow from the fuel inlet passageway to the pump chamber in synchronism with movement of the piston 34.

In a first embodiment of the invention, an electrical control system is provided for controlling the actuation of the valve solenoid. This control circuit generates a pulse width modulated (PWM) signal to the solenoid. Unlike the previously known fuel pump designs, however, the control system varies the width of the pulses generated by the control system to decelerate the movement of the valve just prior to its contact with the housing. Consequently, by decelerating the valve prior to contact between the valve head and its valve seat, as well as contact between the valve anchor and the valve housing, pump noise is effectively reduced.

In a second embodiment of the invention, a chamber containing magneto-rheological fluid (MRF) is disposed around a portion of the valve while an MRF coil is disposed around the MRF chamber to control the activation of the fluid in the MRF chamber. In this embodiment of the invention, the MRF coil is activated just prior to contact between the valve and the pump housing to effectively decelerate the speed of movement of the valve just prior to impact between the valve and the pump housing. Such deceleration, as before, reduces the amount of noise caused by impact of the valve against the pump housing.

In one form, a solenoid is also contained within the housing and cooperates with the valve to hold the valve in an open position for a short period during the pump cycle. However, alternatively, the solenoid may be eliminated and the valve may be maintained open for that same period during the pump cycle by activation of the MRF coil. Such activation effectively operates to prevent movement of the valve and thus maintain it in an open position during that desired period of the pump cycle.

In a still further embodiment of the present invention, the valve head is slidably mounted within a valve chamber while an inlet passageway intersects that valve chamber at a predetermined location. As before, the valve is movable between an open and a closed position by operation of the spring and solenoid, but unlike the previously known fuel pumps, the valve head does not impact against the pump housing and thus does not create the noise of the previously known pumps.

Instead, when in its open position, the valve head is retracted into the valve chamber by a distance sufficient to expose the fuel inlet passageway to the valve chamber thereby establishing fluid communication from the fuel source and to the pump chamber. Conversely, movement of the valve to its extended closed position causes the valve head to cover and fluidly seal against the walls of the valve cavity thus blocking communication between the inlet passageway and the pump chamber.

In a still further modification of the fuel pump of the present invention, the valve head is positioned within the valve chamber while the inlet fuel passageway intersects the valve chamber at a predetermined location. However, rather than reciprocally moving the valve within the valve chamber, the valve is instead rotatably driven by a motor so that the valve head rotates in the valve chamber.

In order to establish fluid communication between the fuel inlet passageway and the pump chamber, at least one, and preferably several circumferentially spaced and axially extending channels are formed on the outer periphery of the valve head. As each channel rotates into registration with the inlet fuel passageway, fluid communication is established between the inlet fuel passageway and the pump chamber through the valve head channel. However, since the valve head merely rotates within the valve chamber and does not impact against the pump housing, pump noise is effectively eliminated.

The present invention provides still further improvements to reduce pump noise. A still further noise reduction strategy is the provision of a turbulence surface along the outlet passage from the pump chamber. Such a turbulence surface effectively reduces pulsations caused throughout the fuel supply system and thus further reduces noise from that system.

In yet a further strategy, a diaphragm is positioned within the pump chamber. The diaphragm flexes in unison with the pressurization of the pump chamber by the piston and also reduces pulsations in the fuel system which otherwise would cause noise.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
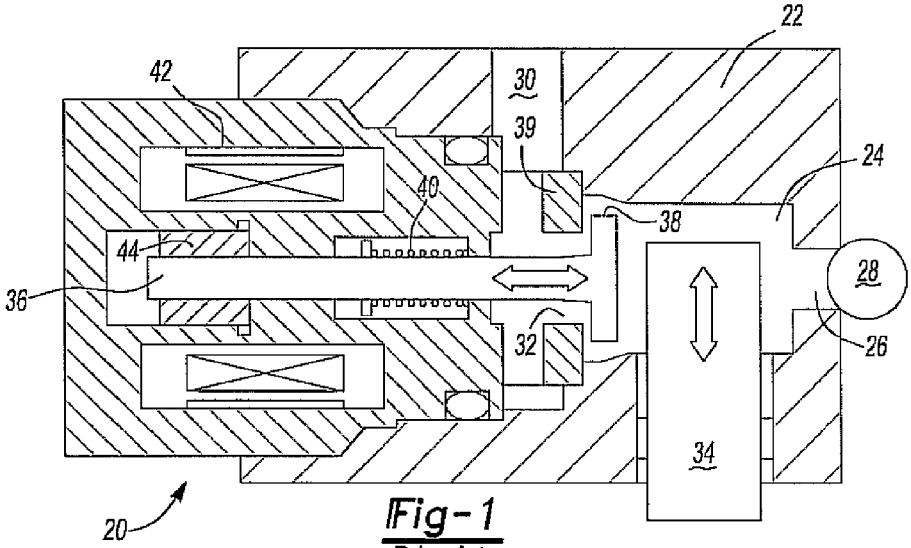
Fig-1 Prior Art
FIG. 1 is a prior art longitudinal sectional view of a prior art fuel pump for a direct injection internal combustion engine.
Figure 2:
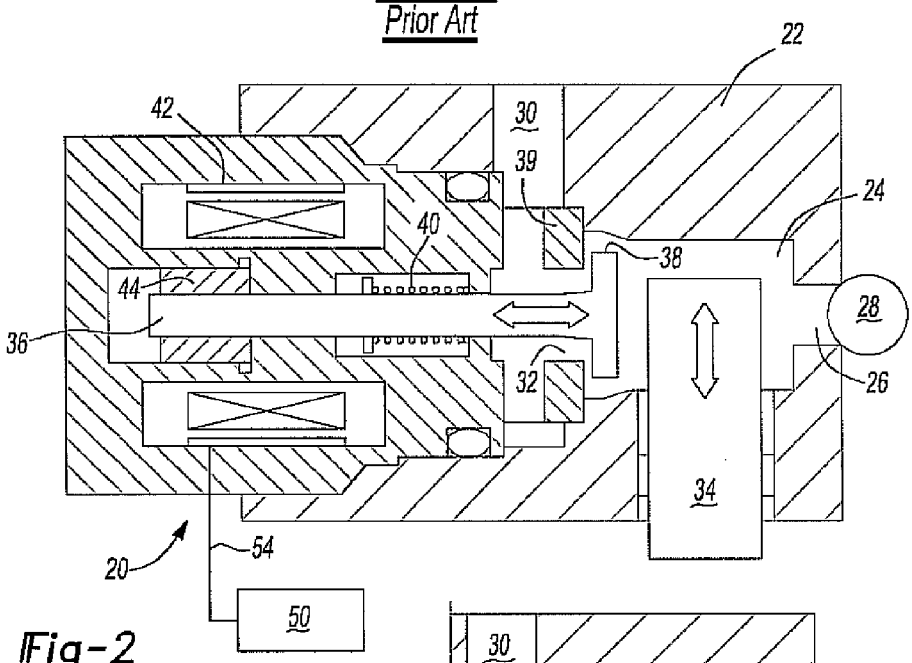
FIG. 2 is a view similar to FIG. 1, but illustrating a modification thereof.

With reference first to FIG. 2, a first embodiment of a high pressure fuel pump 20 is shown which is substantially identical to the previously described prior art fuel pump of FIG. 1 so that the reference characters of FIG. 1 also apply to FIG. 2. As such, the fuel pump 20 includes a pump housing 22 defining a pump chamber 24 having an outlet port 26. A one-way valve 28 is provided at the outlet port 26 which is connected to a fuel rail (not shown) for a direct injection engine.

The housing also includes a fuel inlet passageway 30 which fluidly communicates with the pump chamber 24 through the fluid port 32. A piston 34 is then reciprocally driven into the pump chamber 24 to pressurize the fuel in the pump chamber 24 and provide that pressurized fuel to the fuel rail and then, as the piston 34 moves out of the pump chamber 24, open the valve 36 and induct fuel from the inlet passageway 30, through the port 32, and into the pump chamber 24.

Figure 3:
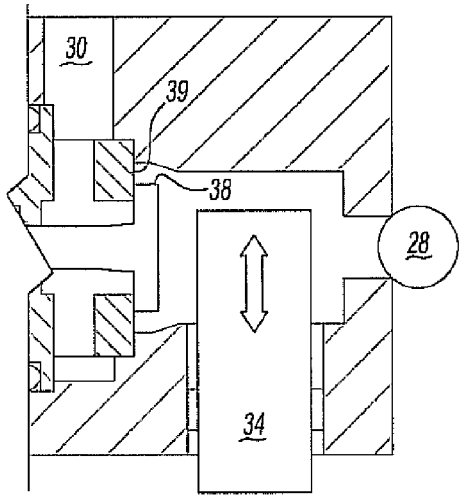
FIG. 3 is a fragmentary view illustrating the valve in a closed position.

The elongated valve 36 is reciprocally movably mounted in the housing 22 and movable between an open position, illustrated in FIG. 2, and a closed position, illustrated in FIG. 3. In its open position, the valve head 38 is positioned away from the portion of the housing 22 forming its valve seat 39 around the port 32 thus permitting fluid flow from the inlet passageway 30 and to the pump chamber 24. Conversely, in its closed position, the valve head 38 abuts against its valve seat 39 and blocks fluid flow from the inlet passageway 30 to the pump chamber 24.

In order to control the movement of the valve 36, a compression spring 40 is disposed around the valve 36 and urges the valve 36 towards its closed position. However, a solenoid 42, when activated, maintains the valve 36 in its open position (FIG. 2).

Figure 4:
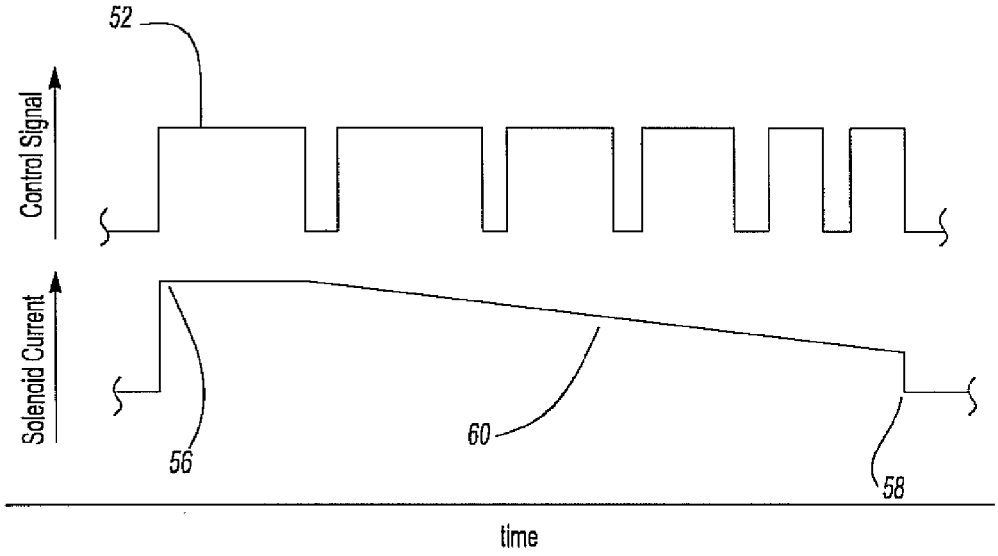
FIG. 4 is a view illustrating the output signal from the solenoid control circuit.

Unlike the previously known fuel pumps, however, the fuel pump 20 of the present invention includes an electrical control circuit 50 which controls the voltage, and thus the current, to the solenoid 42. As best shown in FIG. 4, the electrical control circuit 50 generates a pulse width modulated (PWM) signal 52 on its output 54 (FIG. 2) to decelerate the movement of the valve 36 as it moves from its open and to its closed position.

In particular, as shown in FIG. 4, the pulse width modulated signal 52 decreases the pulse duration from the open position 56 of the valve 36 and to its closed position 58 (FIG. 3) in which the valve head 38 blocks fluid flow from the fuel inlet passageway 30 to the pump chamber 24. This decrease in pulse width duration likewise generates a current profile 60 (FIG. 4) for the solenoid 42 which effectively decelerates the closure of the valve and reduces the speed of impact of the valve head 38 against its valve seat 39. This, in turn, reduces the noise from the fuel pump 20 caused by the impact of the valve head 38 and the valve seat 39.

Similarly, the electrical control circuit 50 may also be used to control the speed of impact of the valve anchor 44 against the pump housing 22. This also is achieved by varying the pulse width duration on the output 54 from the control circuit 50.

Figure 16:
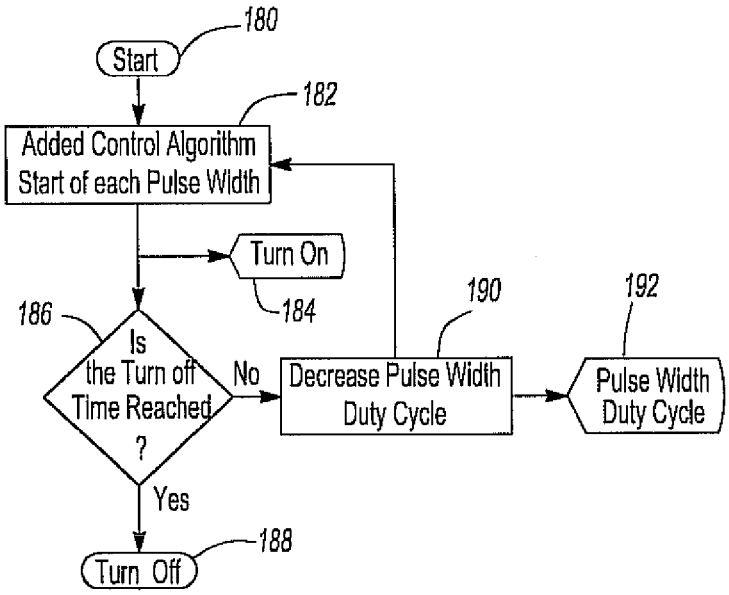
FIG. 16 is a flowchart illustrating the operation of the embodiment of the invention illustrated in FIG. 2.

With reference now to FIG. 16, a flowchart is illustrated for the control of the solenoid between the valve open time 56 and valve closed time 58 (FIG. 4). After the algorithm is initiated at step 180, step 180 proceeds to step 182 which determines if time 56, i.e. the initiation of the pulse train to the solenoid, has been reached. If so, step 182 proceeds to step 184 and initiates activation of the solenoid. Step 184 then proceeds to step 186.

At step 186 it is determined whether or not the turn-off time, namely time 58, has been reached. If so, step 186 proceeds to step 188 and turns off the power to the solenoid. Otherwise, step 186 proceeds to step 190.

At step 190, the pulse width duty cycle is decreased in accordance with a schedule stored in memory 192. Step 190 then proceeds back to step 182 where the above process is reiteratively repeated until the turn-off time 58 has been reached.

Figure 5:
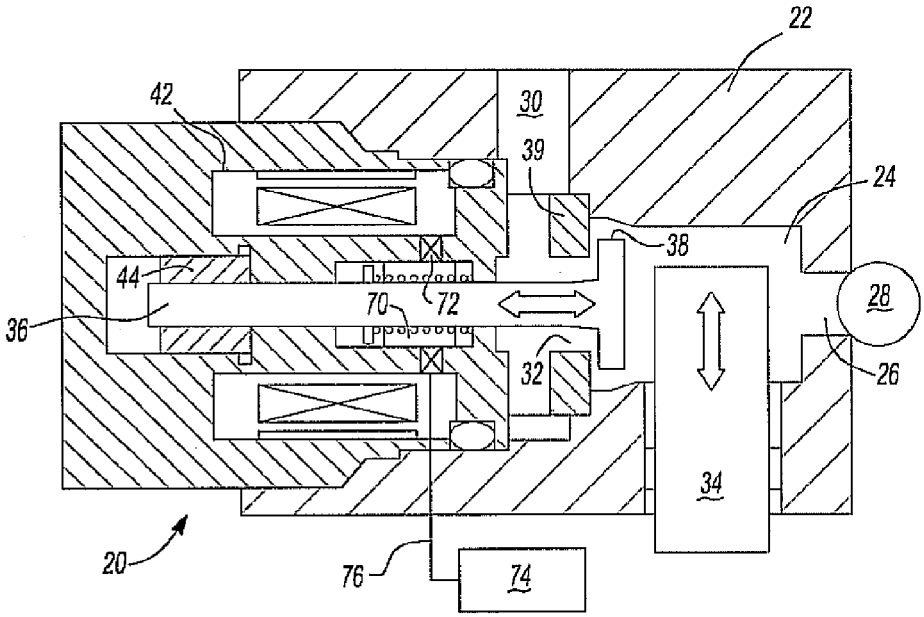
FIG. 5 is a view similar to FIG. 2, but illustrating a modification thereof.

With reference now to FIG. 5, a still further modification of the present invention is shown in which a chamber 70 filled with magneto-rheological fluid (MRF) is provided around a portion of the valve 36. An MRF coil 72 is then contained in the housing surrounding the MRF chamber 70. In the well-known fashion, the viscosity of the fluid in the MRF chamber 70 varies as a function of the magnetic field applied to the chamber 70 by the MRF coil 72.

Consequently, in operation, an MRF control circuit 74 generates a signal on its output 76 to control the magnitude of the magnetic field created by the MRF coil 72.

Figure 8:
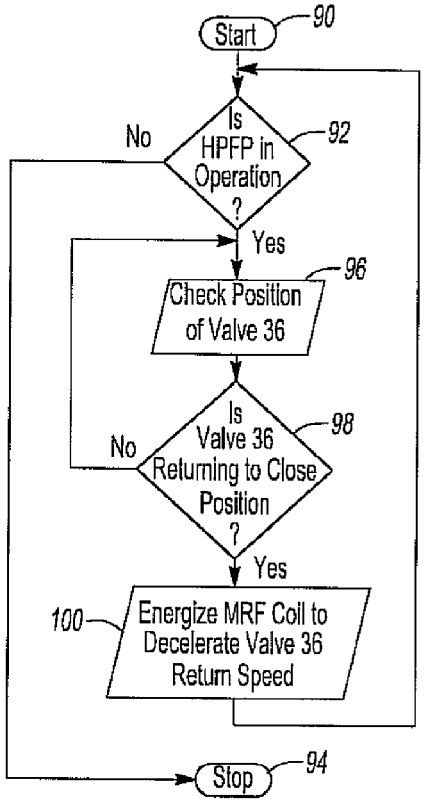
FIG. 8 is a flowchart illustrating the operation of the embodiment of the invention illustrated in FIG. 6.

A flowchart illustrating the operation of the invention is shown in FIG. 8. The operation of the MRF control circuit 74 begins at step 90 and then proceeds to step 92 which determines whether or not the fuel pump 20 is in operation. If not, step 92 branches to step 94 and terminates. However, assuming that the pump 20 is in operation, step 92 instead branches to step 96.

At step 96, the circuit 74 determines the position of the valve 36 and then proceeds to step 98 and determines if the valve 36 is returning to a closed position. If not, step 98 branches back to step 96.

Otherwise, step 98 proceeds to step 100 where the MRF control circuit 74 energizes the MRF coil 72 to decelerate the valve 36 prior to its contact with the pump housing. Step 100 then proceeds back to step 92 where the above process is repeated.

Figure 9:
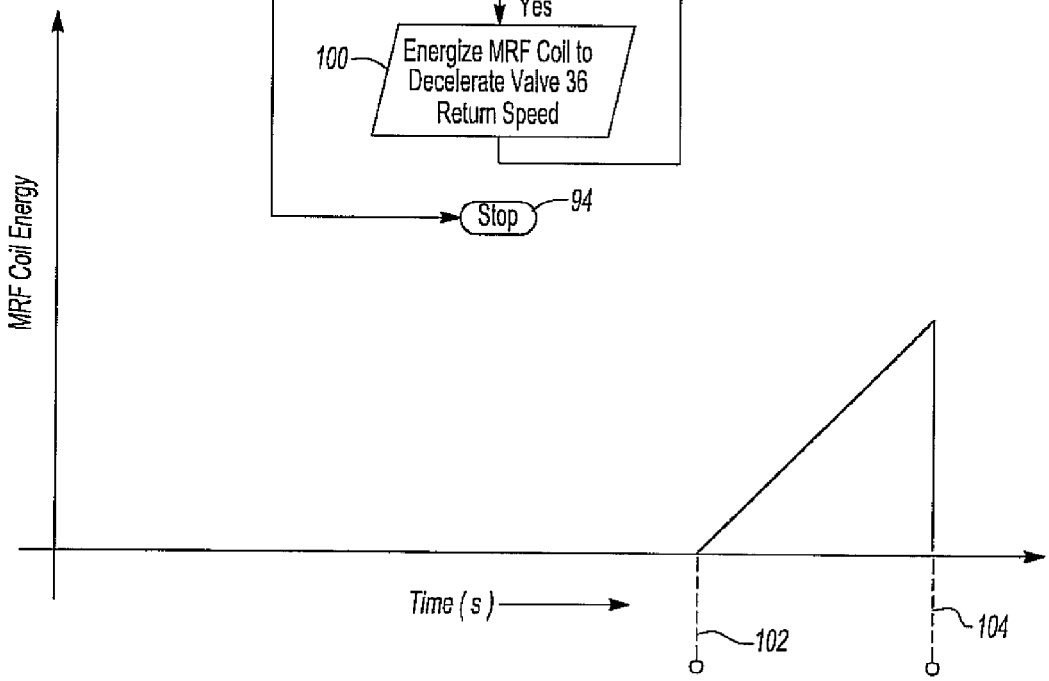
FIG. 9 is a view similar to FIG. 7, but illustrating the operation of the embodiment of the invention illustrated in FIG. 5.

An exemplary output from the MRF control circuit 74 is illustrated in FIG. 9. At time 102 when the valve 36 begins to return to its closed position (see step 98 in FIG. 8), the voltage to the MRF coil 72 increases in a ramp or other function to time 104, i.e. the closure of the valve 36. Consequently, the MRF fluid in the MRF chamber 70 effectively and rapidly decreases the speed of movement of the valve 36 just prior to contact between the valve 36 and housing 22.

Consequently, by synchronizing the output from the MRF control circuit 74 with the desired movement of the valve 36, the MRF fluid in the MRF chamber 70 may be activated just prior to impact of the valve head 38 or valve anchor 44 with the pump housing 22 to decelerate the movement of the valve 36 and reduce the speed of the impact. In doing so, reduction of the impact speed simultaneously reduces the noise caused by that impact and thus reduces the noise from the pump 20.

Figure 6:
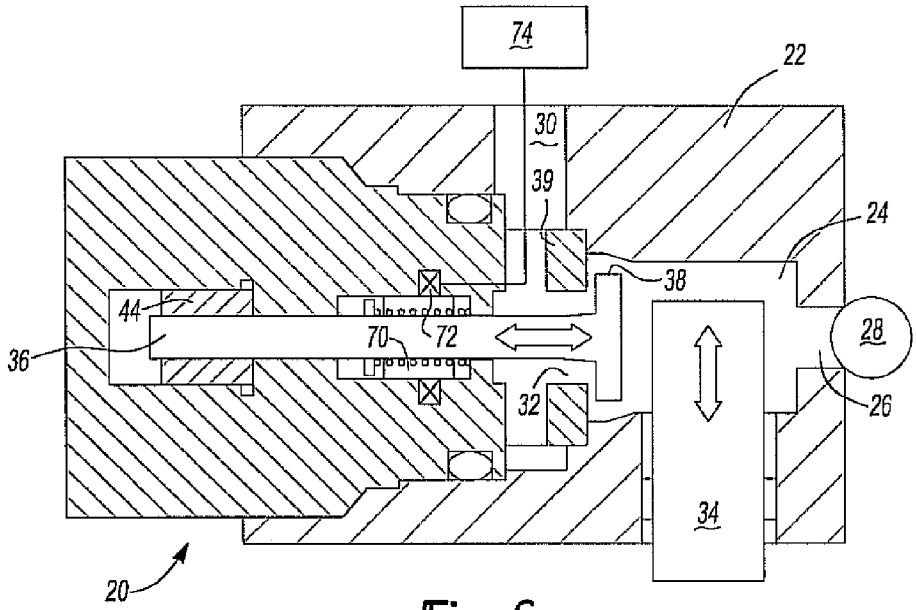
FIG. 6 is a view similar to FIG. 5, but illustrating a modification thereof.

With reference now to FIG. 6, a still further modification of the present invention is shown which is substantially identical to that shown in FIG. 5, except that the solenoid 42 has been eliminated. As previously described, the solenoid 42 (FIG. 5) is used to maintain the valve in an open position as the piston 34 inducts fuel from the fuel inlet passageway 30 into the pump chamber 24. However, by proper programming of the MRF control circuit 74, the MRF fluid in the MRF chamber 70 may be employed to maintain the valve 36 in its open position in synchronism with the movement of the piston 34 and without the need for the solenoid 42 (FIG. 5).

Figure 7:
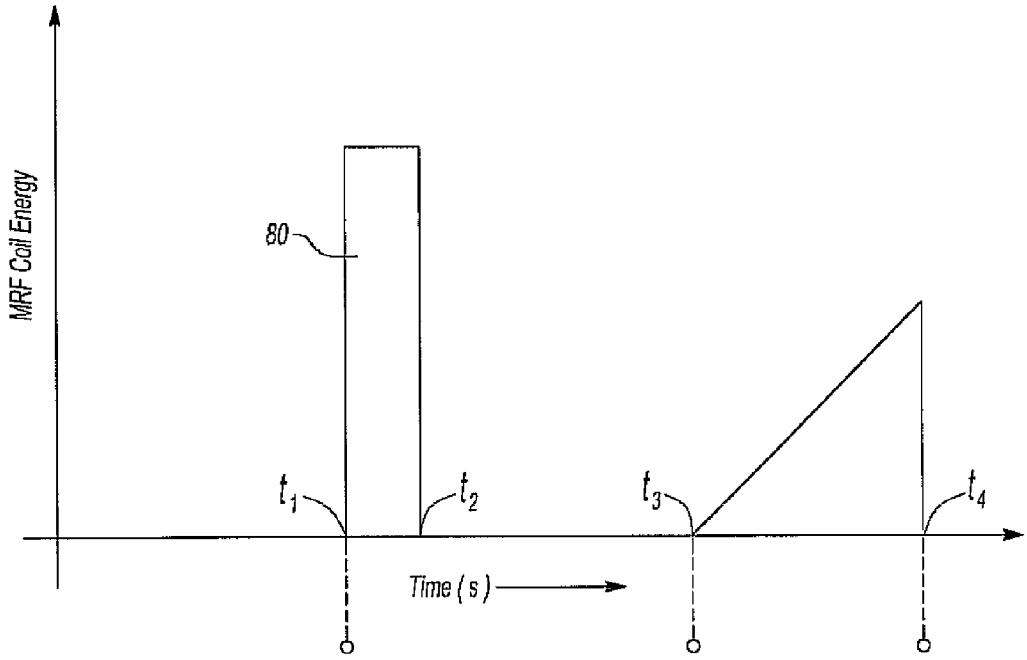
FIG. 7 is a graph illustrating the activation of the MRF coil as a function of time for the embodiment of the invention illustrated in FIG. 6.

With reference now to FIG. 7, an exemplary output from the MRF control circuit is shown. When the valve 36 is in an open position, the MRF control circuit 74 generates a pulse 80 which increases the viscosity of the MRF fluid in the MRF chamber 70 thus holding the valve 36 in an open position as desired. Once the pulse 80 is terminated at time t2, the viscosity of the MRF fluid is reduced thus allowing the spring to return the valve 36 towards its closed position.

However, at time t3 and thus prior to contact of the valve head 38 with its valve seat 39 on the pomp housing 22, the MRF coil is again activated with an increasing energy thus effectively increasing the viscosity of the MRF fluid and decelerating the movement of the valve 36 just prior to closure of the valve 36 at time t4 and thus just prior to the impact of the valve 36 against the housing 22.

Figure 10:
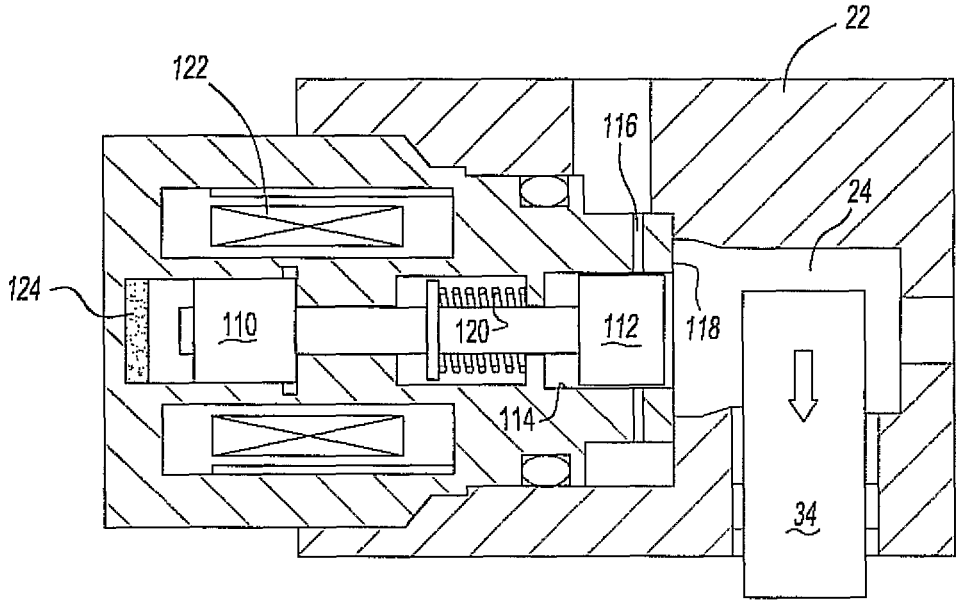
FIG. 10 is a view similar to FIG. 2, but illustrating a modification thereof.

With reference to FIG. 10, a still further modification of the present invention is shown in which a valve 110 is reciprocally mounted within the housing 22 and includes a valve head 112 which is reciprocally mounted within a valve chamber 114 formed in the housing 22. Preferably, both the valve head 112 and the valve chamber 114 are cylindrical in shape and the diameter of the valve head 112 is substantially the same or slightly less than the diameter of the valve chamber 114 so that the outer periphery of the valve head 112 sealingly engages the inner periphery of the valve chamber 114.

A portion of a fuel inlet passageway 116 intersects the valve chamber 114 at a predetermined location spaced from an end 118 of the valve chamber 114. The end 118 of the valve chamber, in turn, is open to the pump chamber 24.

Figure 11:
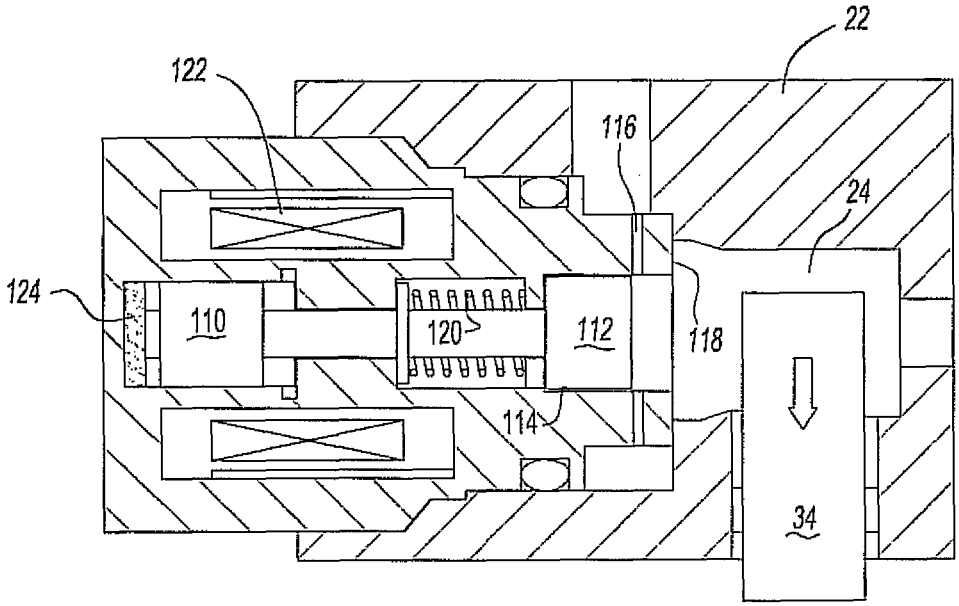
FIG. 11 is a view similar to FIG. 10, but illustrating the valve in an open position.

With reference now to FIGS. 10 and 11, the valve 110 is movable between a closed position, illustrated in FIG. 10, and an open position, illustrated in FIG. 11. In its closed position (FIG. 10) the valve head 112 covers and sealingly closes the inlet passageway 116 thus blocking fluid flow from the inlet passageway 116 and into the pump chamber 24. Conversely, in its open position, the valve head 112 uncovers the location of the intersection between the inlet passageway 116 and the valve chamber 114 and permits fluid flow from the inlet passageway 116 into the pump chamber 24.

As before, a compression spring 120 urges the valve 110 toward an open position while, when activated, the solenoid 122 maintains the valve in its closed position.

Unlike the previously known fuel pump designs for direct injection engines, the fuel pump design illustrated in FIGS. 10 and 11 completely eliminates the impact between the valve head and the pump housing as the valve 110 moves between its open and its closed position. Instead, the valve head 112 merely slides in the valve chamber 114 without creating an impact with the valve housing 22. A damping material 124 may also be provided at one end of the valve 110 to prevent impact between the valve head 112 and an inner end of the valve chamber 114. Elimination of the impact between the valve and the pump housing reduces pump noise in the desired fashion.

Figure 12:
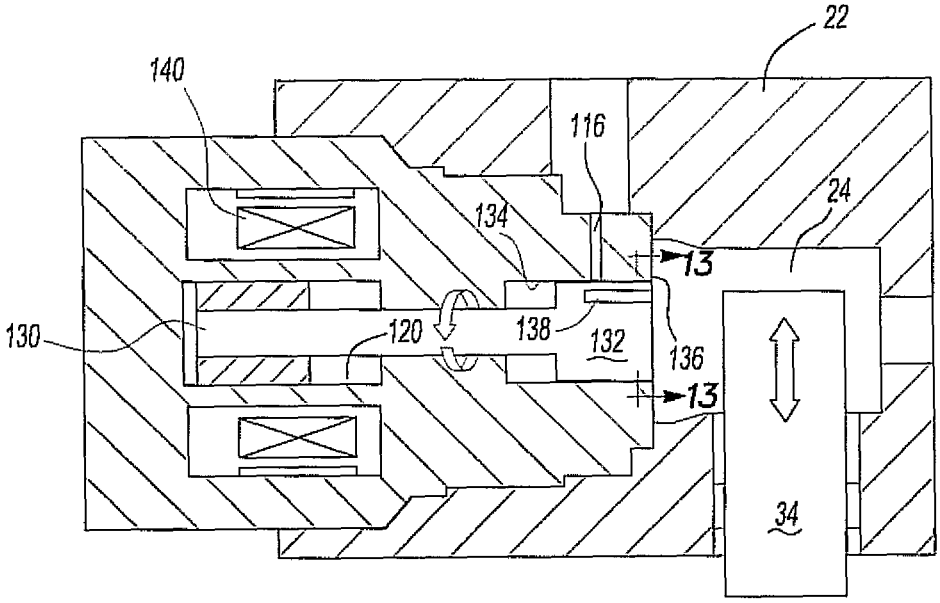
FIG. 12 is a view similar to FIG. 10.
Figure 13:
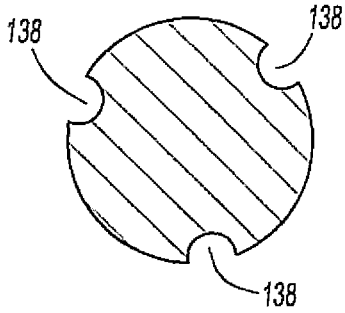
FIG. 13 is a sectional view illustrating the valve head.

With reference now to FIGS. 12 and 13, a still further modification of the present invention is illustrated in which the valve 130 includes a generally cylindrical valve head 132. This valve head 132 is mounted within a likewise cylindrical valve chamber 134. The outer diameter of the valve head 132 is substantially the same or slightly less than the diameter of the valve chamber 134 so that the outer periphery of the valve head 132 sealingly engages the inner periphery of the valve chamber 134.

A part of an inlet fuel passageway 116 is also provided through the pump housing 22 so that the passageway 116 intersects the valve chamber 134 at a location spaced from the end 136 of the valve chamber 134. This end 136, furthermore, is open to the pump chamber 24.

In order to selectively fluidly connect the fuel inlet passageway 116 with the pump chamber 24 in synchronism with the reciprocation of the piston 34, at least one, and preferably several circumferentially spaced and axially extending channels 138 are formed along the outer periphery of the valve head 132. These channels 138 extend from the free end of the valve head 132 to at least the location of the inlet passageway 116. Consequently, upon rotation of the valve head 132, as each channel 138 registers with the inlet passageway 116, fluid communication is established between the inlet passageway 116 and the pump chamber 124. Conversely, the outer periphery of the valve head 132 sealingly engages the inner periphery of the valve chamber 134 thus preventing fluid flow from the inlet passageway 116 and to the pump chamber 24 when the channel 138 does not register with the inlet passageway 116.

Unlike the previously described embodiments of the invention, in this modification of the invention, the valve 130 is rotatably driven by a motor 140, such as a stepping motor or a DC controllable motor, such that rotation of the valve 130 is synchronized with the movement of the piston 34. However, the valve 130 is constrained against axial movement.

Since the valve 130 merely rotates within the pump housing 22, all impact of the valve with the pump housing 22 is eliminated along with noise created by such impact.

Figure 14:
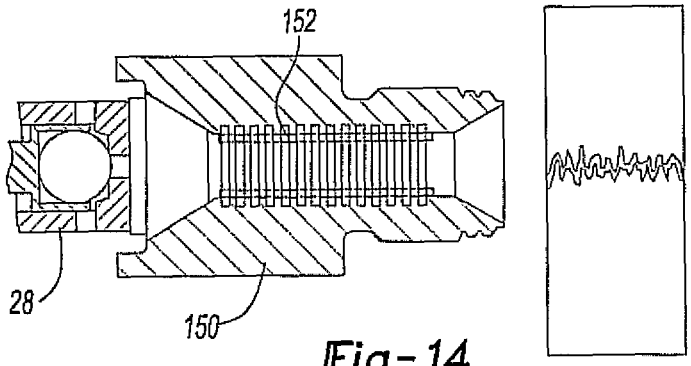
FIG. 14 is a longitudinal sectional view illustrating yet a further modification of the present invention.

With reference now to FIG. 14, a still further strategy to reduce noise in the fuel system for a direct injection internal combustion engine is illustrated. In particular, an outlet pipe 150 is attached to the outlet 28 from the pump chamber. This outlet pipe 150 includes a turbulent boundary layer 152 which enables laminar flow to flow smoothly through the fuel system while the eddy of the turbulent flow is trapped along the turbulent boundary layer 152. Any conventional means, such as grooves, dimples, etc., may be used to form the turbulent boundary layer 152.

By increasing the laminar fuel flow through the outlet pipe 150, pressure pulsation throughout the remainder of the fuel system is reduced thus reducing noise created by such fuel pressure pulsation.

Figure 15A:
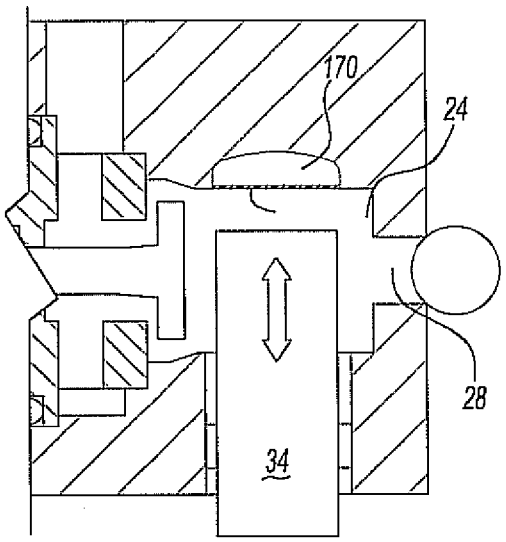
FIGS. 15A and 15B are diagrammatic views illustrating yet a further modification of the present invention.
Figure 15B:
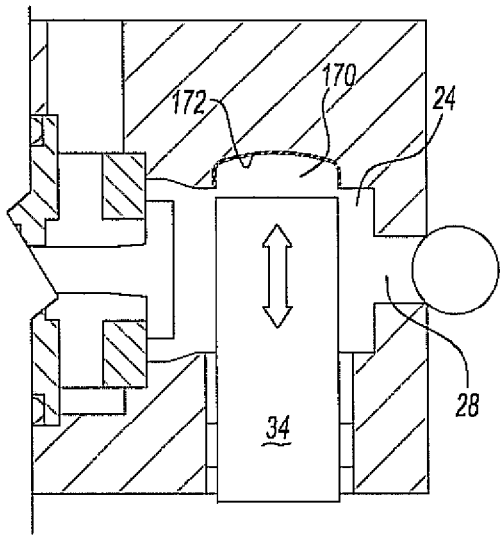

With reference now to FIGS. 15A and 15B, a still further modification of the present invention is shown in which a pressure relief chamber 170 is formed along one side of the pump chamber 24. The pressure relief chamber 170 is covered by a diaphragm 172 which may be fluid permeable.

In operation, as the piston 34 compresses the fuel in the pump chamber 24 and forces that fuel out through the outlet 28, the diaphragm flexes from the position shown in FIG. 15A to the position shown in FIG. 15B thereby absorbing at least a portion of the pressure pulsation caused by the piston 34. This, in turn, reduces the amount of pressure pulsation transmitted through the remainder of the fuel system thereby reducing noise from the fuel pump.

From the foregoing, it can be seen that the present invention provides a number of different strategies to reduce the noise from the fuel pump in a high pressure fuel pump of the type used for direct injection internal combustion engines. Having described our invention, however, many modifications thereto will become apparent to those skilled in the art to which it pertains without deviation from the spirit of the invention as defined by the scope of the appended claims.

We claim:

1. A fuel pump comprising:

a housing defining a pump chamber, a port formed in said housing which fluidly connects a fuel inlet passageway to said pump chamber, an elongated valve axially slidably mounted in said housing and having a valve head, said valve movable between an open position in which said valve head is spaced from said port thus allowing fluid flow through said port, and a fully closed position in which said valve head contacts said housing around said port and prevents fluid flow through said port, a solenoid which controls the movement of said valve, an electrical control circuit electrically connected to said solenoid which generates a continuously decreasing output current to control the solenoid for continuously decelerating said valve as said valve moves from said open to said fully closed position.

2. The fuel pump as defined in claim 1 wherein said electrical control circuit generates a pulse width modulated output signal to said solenoid.

3. The fuel pump as defined in claim 2 wherein said electrical control circuit varies the width of the pulses as said valve moves from said open to said closed position to decelerate said valve prior to contact between said valve head and said housing.

4. A fuel pump comprising:

a housing defining a pump chamber, a port formed in said housing which fluidly connects a fuel inlet passageway to said pump chamber, an elongated valve axially slidably mounted in said housing and having a valve head, said valve movable between an open position in which said valve head is spaced from said port thus allowing fluid flow through said port, and a fully closed position in which said valve head contacts said housing around said port and prevents fluid flow through said port, said housing having a magneto-rheological fluid (MRF) chamber surrounding at least a portion of said valve, an MRF coil contained in said housing around said MRF chamber, an MRF electrical control circuit electrically connected to said MRF coil which generates a continuously decreasing output current to control the MRF coil for continuously decelerating said valve as said valve moves from said open to said fully closed position.

5. The fuel pump as defined in claim 1 wherein said MRF electrical control circuit generates an increasing voltage signal to said MRF coil as said valve moves from said open position to said closed position.

6. The fuel pump as defined in claim 4 and comprising a spring which urges said valve toward said closed position and wherein said MRF electrical control circuit generates a signal to said MRF coil when said valve is in said open position to hold said valve in said open position against the force of said spring.

7. The fuel pump as defined in claim 6 wherein said MRF electrical control circuit generates an increasing voltage signal to said MRF coil as said valve moves from said open position to said closed position.

8. A fuel pump comprising:

a housing defining a pump chamber, a fuel inlet passageway and a valve chamber fluidly connected in series between said fuel inlet passageway and said pump chamber, a valve having a valve head, said valve head being movably mounted in said valve chamber and movable between an open position in which said fuel inlet passageway is fluidly connected through said valve chamber to said pump chamber and a fully closed position in which said valve head blocks said fuel inlet passageway and prevents fluid flow from said fuel inlet passageway to said pump chamber, an actuator which, under control of a control circuit, moves said valve head between said open and said closed position, wherein said control circuit generates a continuously decreasing current output signal to said actuator to continuously decelerate said valve as said valve moves from said open to said fully closed position.

9. The fuel pump as defined in claim 8 wherein said inlet passageway intersects said valve chamber at a location between axial ends of said valve chamber, said valve head being axially slidably mounted in said valve chamber, said valve head being retracted behind said location when in said open position and extending over and fluidly sealing said location when in said closed position.

10. The fuel pump as defined in claim 9 wherein said actuator comprises a solenoid.

11. The fuel pump as defined in claim 9 and comprising dampening material disposed between an end of said valve and said housing.

12. The fuel pump as defined in claim 8 wherein said inlet passageway intersects said valve chamber at a location between axial ends of said valve chamber, said valve head being rotatably mounted in said valve chamber and including at least one axially extending channel formed on its outer periphery, said channel extending from said location to said pump chamber when said valve is in said open position, said outer periphery of said valve head extending over and fluidly sealing said location when in said closed position.

13. The fuel pump as defined in claim 12 and comprising a motor for rotatably driving said valve head.

14. The fuel pump as defined in claim 13 wherein said motor comprises a stepping motor and comprising a control circuit which controls activation of said stepping motor.

15. The fuel pump as defined in claim 8 and comprising a diaphragm mounted in said pump chamber.

16. The fuel pump as defined in claim 15 wherein said diaphragm is fluid permeable.

17. The fuel pump as defined in claim 8 and comprising an outlet passageway having one end fluidly connected to said pump chamber, said outlet passageway having a turbulence inducing layer.

* * * * *